US011306515B2

(12) United States Patent
VandenBrink

(10) Patent No.: US 11,306,515 B2
(45) Date of Patent: Apr. 19, 2022

(54) RESETTABLE INERTIA LOCK ASSEMBLY

(71) Applicant: ADAC Plastics, Inc., Grand Rapids, MI (US)

(72) Inventor: Eric Allyn VandenBrink, Holland, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 943 days.

(21) Appl. No.: 15/981,267

(22) Filed: May 16, 2018

(65) Prior Publication Data

US 2018/0334837 A1 Nov. 22, 2018

Related U.S. Application Data

(60) Provisional application No. 62/507,437, filed on May 17, 2017.

(51) Int. Cl.
*E05B 77/06* (2014.01)

(52) U.S. Cl.
CPC ..... *E05B 77/06* (2013.01)

(58) Field of Classification Search
CPC ..... E05B 77/02; E05B 77/04; E05B 77/06; Y10S 292/22; Y10S 292/65
See application file for complete search history.

(56) References Cited

U.S. PATENT DOCUMENTS 4,904,004 A * 2/1990 Bartczak ..... E05B 77/10 292/201
6,042,159 A * 3/2000 Spitzley ..... E05B 77/06 16/111.1
7,597,368 B2 10/2009 Savant et al.
9,151,090 B2 10/2015 Beck
(Continued)

FOREIGN PATENT DOCUMENTS

EP 1607555 A2 12/2005
KR 10-2013-006348 A 1/2013
(Continued)

OTHER PUBLICATIONS

PCT Written Opinion of the International Searching Authority.
(Continued)

*Primary Examiner* — Mark A Williams
(74) *Attorney, Agent, or Firm* — Barnes & Thornburg LLP

(57) ABSTRACT

A resettable inertia lock assembly may include a chassis configured to be mounted within an access closure of a motor vehicle, a cassette, a reset structure defined on one of the chassis and the cassette, a resettable locking apparatus carried by the cassette and including an inertia-activated member and an engagement coupler, the engagement coupler movable between a first position securing the inertia-activated member in an inertia-activated position and a second position in which the engagement coupler does not secure the inertia-activated member in the inertia-activated position, and a movement device for producing a relative movement between the chassis and the cassette to cause the reset structure to engage and move the engagement coupler from the first position to the second position thereof to allow the inertia-activated member to move from the inertia-activated position to a home position.

12 Claims, 15 Drawing Sheets

(56) References Cited

U.S. PATENT DOCUMENTS

| | | | | |
|---|---|---|---|---|
| 10,006,228 | B2 | 6/2018 | Kim | |
| 2007/0069533 | A1* | 3/2007 | Cummins | E05B 77/04 292/336.3 |
| 2013/0056999 | A1* | 3/2013 | Beck | E05B 77/02 292/336.3 |
| 2013/0234455 | A1* | 9/2013 | Rocci | E05B 85/16 292/336.3 |
| 2014/0245568 | A1* | 9/2014 | Breimayer | E05B 79/06 16/110.1 |
| 2014/0319857 | A1 | 10/2014 | Zimmer et al. | |
| 2017/0044802 | A1* | 2/2017 | Beck | E05B 85/10 |
| 2019/0048628 | A1* | 2/2019 | Pudney | E05B 79/06 |
| 2019/0301208 | A1* | 10/2019 | Cimpean | E05B 77/04 |

FOREIGN PATENT DOCUMENTS

| | | | |
|---|---|---|---|
| KR | 20130006348 | A | 1/2013 |
| KR | 10-2015-0093657 | A | 8/2015 |
| KR | 10-1610499 | B1 | 4/2016 |
| WO | 2014055902 | A1 | 4/2014 |

OTHER PUBLICATIONS

Extended European Search Report for related European Application No. 188015275.5 dated Feb. 1, 2021, 8 pages.

Chinese Office Action for Chinese Patent Application No. 201880047493.0 dated Apr. 23, 2021.

First Office Action and Search Report for related Chinese Patent Application No. 201880047493.0 dated Sep. 27, 2020 (with translation), 20 pages.

Search Report for co-pending International Patent Application No. PCT/US2018/32887; dated Sep. 6, 2018.

* cited by examiner

RESETTABLE INERTIA LOCK ASSEMBLY

CROSS-REFERENCE TO RELATED APPLICATION

This patent application claims the benefit of, and priority to, U.S. Provisional Patent Application Ser. No. 62/507,437, filed May 17, 2017, the disclosure of which is incorporated herein by reference.

TECHNICAL FIELD

This disclosure relates to motor vehicle access closure handle assemblies incorporating an inertia lock assembly for preventing the unintended opening of the access closure in the event of an impact.

BACKGROUND

Motor vehicle access closure latch assemblies frequently incorporate a handle assembly with a release handle that is pulled away from the access closure in order to operate the latch mechanism and open the access closure. In the case of an impact event such as a collision, particularly one that generates an impact force vector perpendicular to the side of the motor vehicle, the acceleration of the motor vehicle in the direction of the side-acting force vector can cause the release handle to pull away from the access closure, thereby inadvertently actuating the latch mechanism.

In order to minimize the potential for unintended, impact-induced access closure opening, inertia lock assemblies have been developed that impede the unintended movement of the release handle assembly and/or access closure opening actuator resulting from an impact to the motor vehicle. These subassemblies are activated between an at-rest position, wherein the access closure, if functional, can be opened by operating the release handle, and a blocking position wherein opening of the access closure is prevented by impact-generated forces. Impedance of the movement of the release handle assembly or access closure opening actuator can thus be accomplished by controlling impact-based acceleration and inertial effects associated with the inertia lock assembly.

SUMMARY

The present disclosure may comprise one or more of the features recited in the attached claims, and/or one or more of the following features and combinations thereof. In one aspect, a resettable inertia lock assembly may comprise a chassis configured to be mounted within an access closure of a motor vehicle, a cassette, a reset structure defined on one of the chassis and the cassette, a resettable locking apparatus carried by the cassette and including an inertia-activated member and an engagement coupler, the engagement coupler movable between a first position securing the inertia-activated member in an inertia-activated position and a second position in which the engagement coupler does not secure the inertia-activated member in the inertia-activated position, and a movement device for producing a relative movement between the chassis and the cassette to cause the reset structure to engage and move the engagement coupler from the first position to the second position thereof to allow the inertia-activated member to move from the inertia-activated position to a home position.

In another aspect, in an inertia lock apparatus having a chassis configured to be mounted within an access closure of a motor vehicle, a cassette and a resettable locking apparatus mounted to the cassette, the resettable locking apparatus including an engagement coupler engaging an inertia-activating member to secure the inertia-activating member in an inertia-activated position, a method of resetting the apparatus may comprise executing relative movement between the chassis and the cassette along a first direction to cause a portion of the engagement coupler to move from a first position at one side of a first reset structure defined on one of the chassis and the cassette to a second position at an opposite side of the first reset structure, and with the portion of the engagement coupler in the second position, executing relative movement between the chassis and the cassette along a second direction opposite the first direction to cause the opposite side of the first reset structure to engage the portion of the engagement coupler and move the engagement coupler out of engagement with the inertia-activating member to allow the inertia-activated member to move from the inertia-activated position to a home position.

In a further aspect, a resettable inertia lock assembly may comprise a chassis configured to be mounted within an access closure of a motor vehicle, a cassette, a resettable locking apparatus carried by the cassette and including an inertia-activated member responsive to an acceleration force to move from a home position to an inertia-activated position and an engagement coupler movable between a first position engaging the inertia-activated member to secure the inertia-activated member in the inertia-activated position and a second position disengaged from the inertia-activated member to allow the inertia-activated member to return to the home position, a reset structure defined on one of the chassis and the cassette, the reset structure defining a ramp extending away from a surface of the one of the chassis and the cassette, the ramp surface engaging a portion of the engagement coupler in the first position of the engagement coupler to inhibit movement of the engagement coupler from the first position to the second position thereof.

DETAILED DESCRIPTION

For the purposes of promoting an understanding of the principles of this disclosure, reference will now be made to a number of illustrative embodiments shown in the attached drawings and specific language will be used to describe the same.

This disclosure relates to a resettable inertia lock assembly mountable within or to an access closure of a motor vehicle. The assembly includes a conventional bellcrank member actuatable in a conventional manner by an in-vehicle and/or an external handle to actuate and unlatch a latch mechanism of the access closure to allow the access closure to open. The assembly further includes a resettable locking apparatus movable under acceleration conditions resulting from an impact event from a default home position to an inertia-activated position which blocks movement of the bellcrank member to an access closure latch mechanism unlatching position and thereby prevents unlatching of the access closure latch mechanism. The resettable locking apparatus illustratively remains in the inertia-activated position until reset, e.g., manually, in a manner which physically returns the resettable locking apparatus to the home position.

Referring to the Figures, wherein like numerals indicate corresponding parts throughout the several views, an embodiment is shown of a resettable inertia lock assembly 10. Referring specifically to FIGS. 1-5, the assembly 10 is shown in its default, i.e., in a non-inertia-activated, state in which, as will be described in detail below, the assembly 10 allows and provides for actuation in a conventional manner, e.g., via an in-vehicle and/or an external handle, of an access closure latching mechanism to unlatch and opening of an access closure of the motor vehicle to or in which the assembly 10 is mounted.

Figure 1:
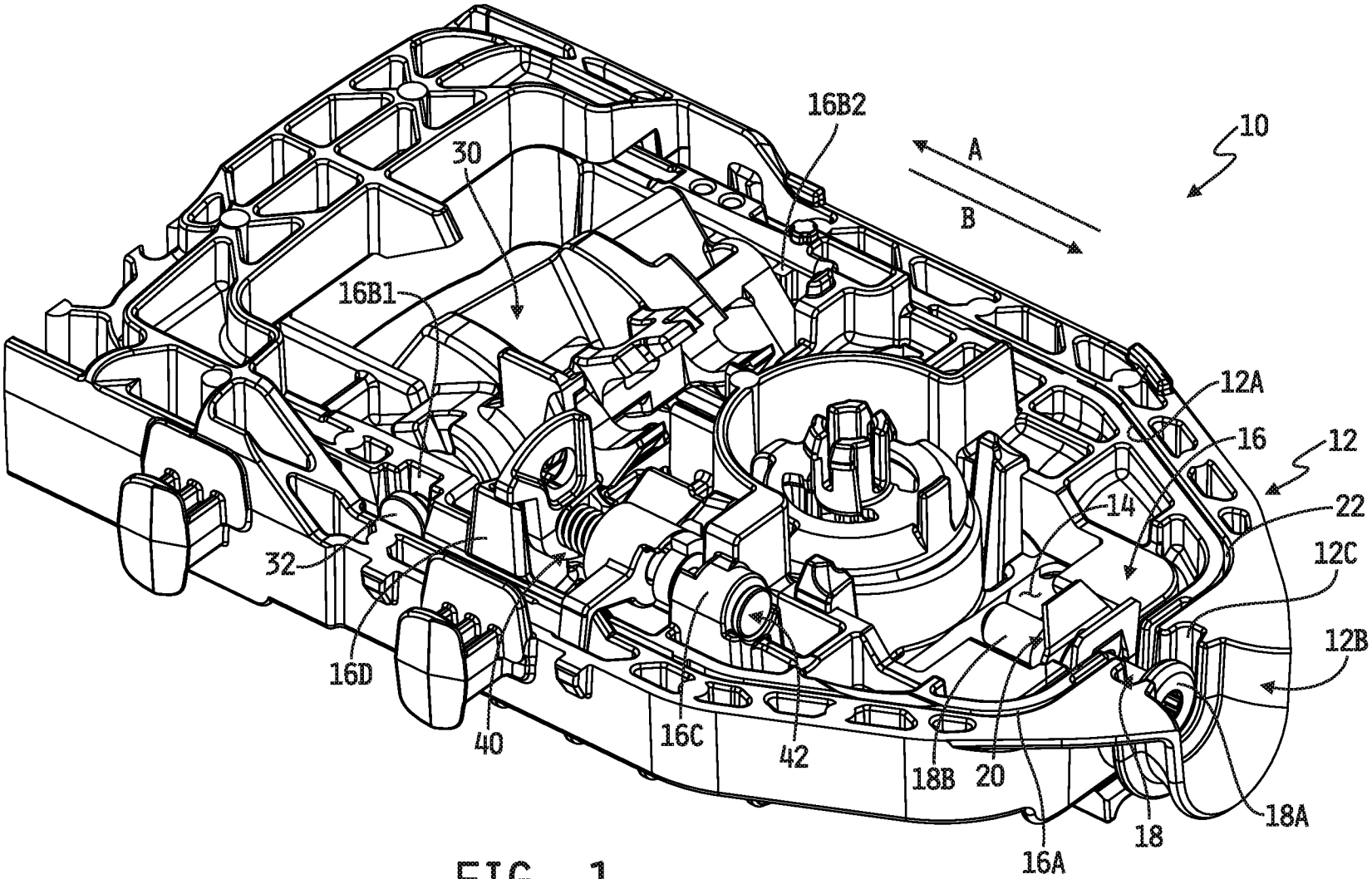
FIG. 1 is a perspective view of an embodiment of a resettable inertia lock assembly shown with the inertia lock member in its home position.

Referring specifically to FIG. 1, the illustrated resettable inertia lock assembly 10 includes a carrier chassis 12 configured to be mounted to or within an access closure of a motor vehicle. Examples of access closures to or within the carrier chassis may be mounted may include, but are not limited to, hinged side doors, hinged rear doors, hinged rear hatches, sliding side doors, manually openable and/or closable doors of any type, automatically openable and/or closable doors of any type, and the like. In any case, the carrier chassis 12 has an inner perimeter wall 12A which defines a compartment 14 within the carrier chassis 12. A slidelock cassette 16 is positioned within the compartment 14, and the slidelock cassette has an outer perimeter wall 16A which faces the inner perimeter wall 12A of the carrier chassis 12 at least partially about the carrier chassis 12 and the slidelock cassette 16.

Figure 10:
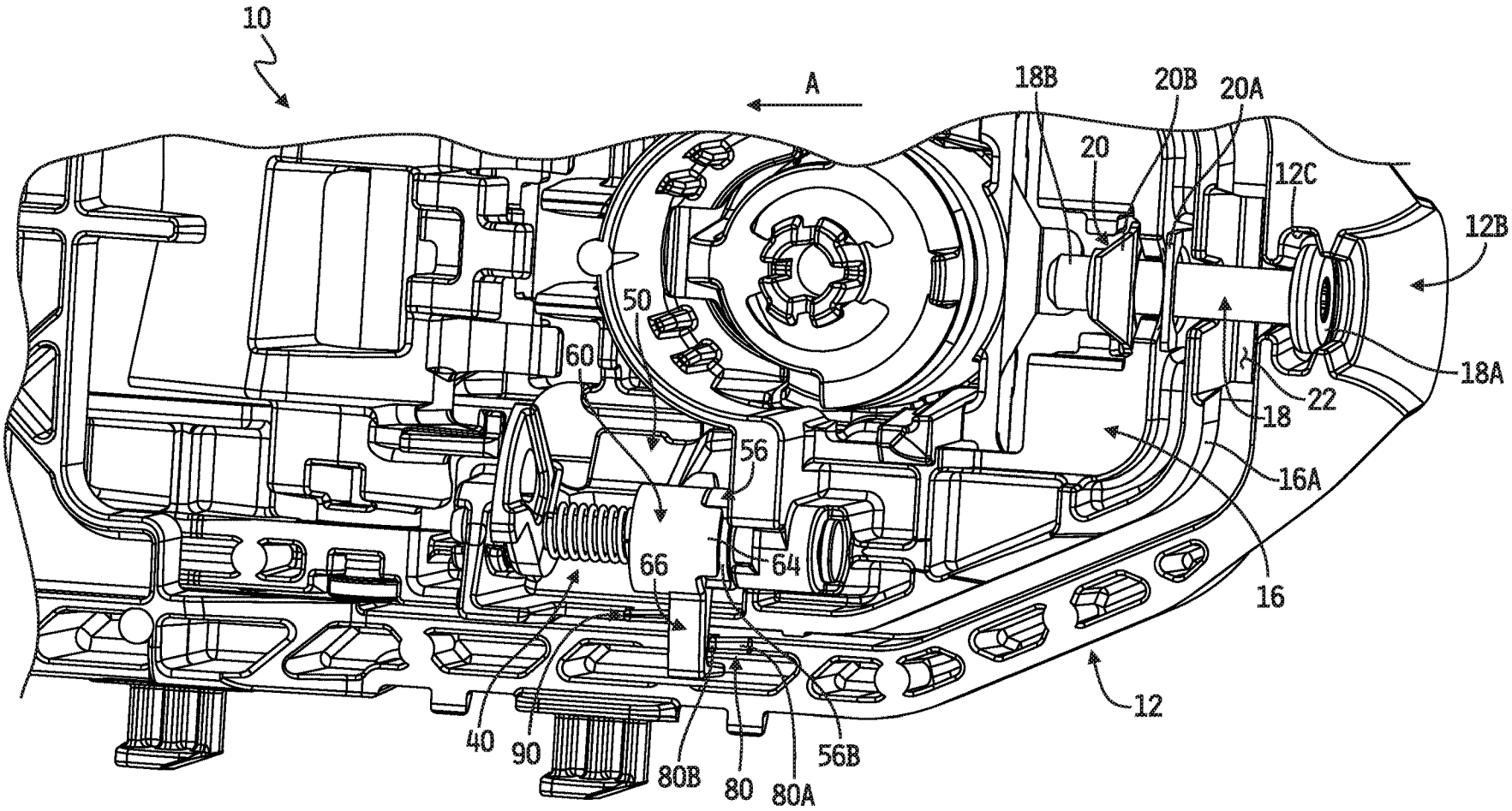
FIG. 10 is a perspective view of the inertia lock assembly shown in the process of resetting the resettable lock apparatus.

As best illustrated in FIG. 1, one end 12B of the carrier chassis 12 defines a slot 12C sized to receive at least a portion of a head 18A of a screw or bolt 18 having a threaded shaft 18B extending therefrom. A corresponding end of the slidelock cassette 16 opposite the slot 12C has an engagement clip 20 coupled thereto which is configured to threadingly engage the threaded shaft 18B of the screw or bolt 18. Illustratively, the engagement clip 20 may include spaced apart clip portions 20A, 20B as illustrated in FIG. 10, although in other embodiments only a single clip portion may be used. In any case, with the head 18A of the screw or bolt 18 trapped within the slot 12C and thereby axially fixed to the carrier chassis 12, the threaded shaft 18B extends into and engages the engagement clip(s) 20 as shown. Advancement of the threaded shaft 18B out of the engagement clip(s) 20, e.g., by rotating the head 12A in one direction, illustratively forces the slidelock cassette 16 linearly away from the end 12B of the carrier chassis 12 in the direction A illustrated in FIG. 1, and advancement of the threaded shaft 18B into the engagement clip(s) 20, e.g., by rotating the head 12A in the opposite direction, illustratively forces the slidelock cassette 16 linearly toward the end 12B of the carrier chassis 12 in the direction B illustrated in FIG. 1. It will be understood that the threaded bolt 18 and corresponding engagement clip(s) 20 represent only one example implementation of a movement device for producing relative movement between the carrier chassis 12 and the slidelock cassette 16, whether for selectively forcing the slidelock cassette 16 away from and toward the end 12B of the carrier chassis 12 or vice versa, and that such a movement device may alternatively be provided in the form of one or more other conventional structures and/or techniques for accomplishing this feature. It will be further understood that all such structures and techniques implementable as the movement device (or as one or as one or more such movement devices) for producing relative movement between the carrier chassis 12 and the slidelock cassette 16 are intended to fall within the scope of this disclosure.

Forcing the slidelock cassette 16 linearly away from the end 12B of the carrier chassis 12 increases the width of a slot 22 defined between the outer perimeter wall 16A of the slidelock cassette 16 and the inner perimeter wall 12A of the carrier chassis 12 adjacent to the slot 12C (see, e.g., FIG. 10), and forcing the slidelock cassette 16 linearly toward the end 12B of the carrier chassis 12 decreases the width of the slot 22 as illustrated in FIG. 1. In the default state of the inertia lock assembly 10 illustrated in FIGS. 1-5, the threaded shaft 18B is maximally advanced into the engagement clip 20 so that the width of the slot 2 is at its minimum or is non-existent (i.e., such that the outer perimeter wall 16A of the slidelock assembly 16 abuts the inner perimeter wall 12A of the carrier chassis 12 adjacent to the end 12B of the carrier chassis 12).

The threaded bolt 18 and engagement clip(s) 20 are illustratively provided for the purpose of selectively forcing the slidelock cassette 16 away from and toward the end 12B of the carrier chassis 12 when resetting the inertia lock assembly 10, as will be described below with respect to FIGS. 10-15. In the default state of the inertial lock assembly 10 illustrated in FIGS. 1-5, the threaded shaft 18B and engagement clip 20 operate only to secure the positions of the slidelock cassette 16 and the carrier chassis 20 relative to one another with the outer perimeter wall 16A of the slidelock cassette 16 adjacent to or in contact with the inner perimeter wall 12A of the carrier chassis 20 adjacent to the slot 12C as illustrated in FIG. 1.

As further illustrated in FIGS. 1-5, the inertia lock assembly 10 illustratively includes a bellcrank 30 rotatably mounted to a spindle or shaft 32 secured to and between opposed wall portions 16B1, 16B2 of the slidelock cassette 16. Illustratively, the spindle 32 extends axially through the bellcrank 30 in a direction that is approximately perpendicular to the directional arrows A, B illustrated in FIG. 1. Operation of the bellcrank 30 is conventional in the default state of the inertia lock assembly 10 in that bellcrank is rotatable about the spindle 32 in response to movement of an access closure handle of a motor vehicle. The bellcrank 30 is illustratively configured to actuate a latch mechanism (not shown) carried by the motor vehicle upon rotation of the bellcrank 30 to an unlatching position, wherein such actuation of the latching mechanism likewise moves the latch mechanism into an unlatched position to allow the access closure to be opened.

Figure 2:
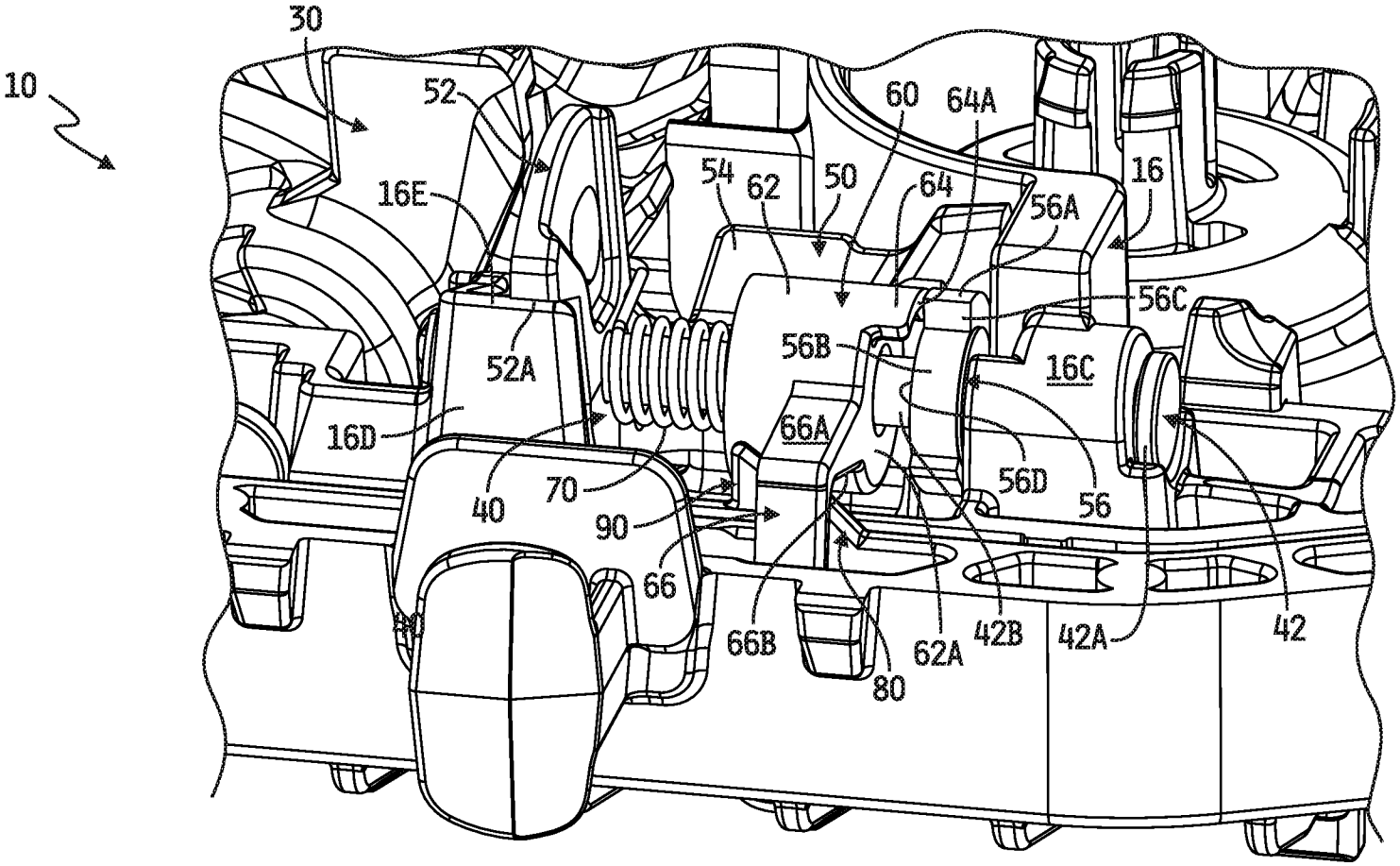
FIG. 2 is a magnified perspective view of the resettable locking apparatus of the inertia lock assembly illustrated in FIG. 1.

The inertia lock assembly 10 further illustratively includes a resettable locking apparatus 40 operatively mounted to the slidelock cassette 16. As best illustrated in FIG. 2, the resettable lock apparatus 40 includes an inertia-activated member 50 and an engagement coupler 60 each rotatably mounted to a spindle 42 secured to and between opposed wall portions 16C, 16D of the slidelock cassette 16. Illustratively, the spindle 42 includes a head portion 42A sized to engage the wall portion 16C of the slidelock cassette 16 and an elongated shaft portion 42B extending away from the head portion 42A. The spindle shaft 42B illustratively extends axially through the inertia-activated member 50 and through the engagement coupler 60 in a direction that is approximately perpendicular to the bellcrank spindle 32 and that is approximately parallel with the directional arrows A, B illustrated in FIG. 1. The inertia-activated member 50 and the engagement coupler 60 are each rotatable relative to and about the spindle shaft 42B, and the engagement coupler 60 is also axially movable along the spindle shaft 42B as will be described below.

The inertia-activated member 50 illustratively includes an inertia lock member 52 and a securement member 56 interconnected by a body portion 54 such that the inertia lock member 52 and the securement member 56 are axially spaced apart from one another along the spindle shaft 42B. The inertia lock member 52 and the securement member 56 are rotatable together as a single unit relative to and about the spindle shaft 42B in a clockwise direction C and in a counterclockwise direction D as illustrated by example in FIG. 3. Illustratively, the clockwise and counterclockwise directions C, D are defined purposes of this disclosure as being oriented as described from the viewpoint of the end 12B of the carrier chassis 12. In the illustrated embodiment, the inertia lock member 52, the body portion 54 and the securement member 56 are integral and of unitary construction, although in alternate embodiments two or more of the inertia lock member 52, the body portion 54 and the securement member 56 may be separate pieces attached together to form the inertia-activated member 50. In any case, the engagement coupler 60 is rotatably mounted to the spindle shaft 42B between the inertia lock member 52 and the securement member 56 as illustrated in the attached figures.

Figure 3:
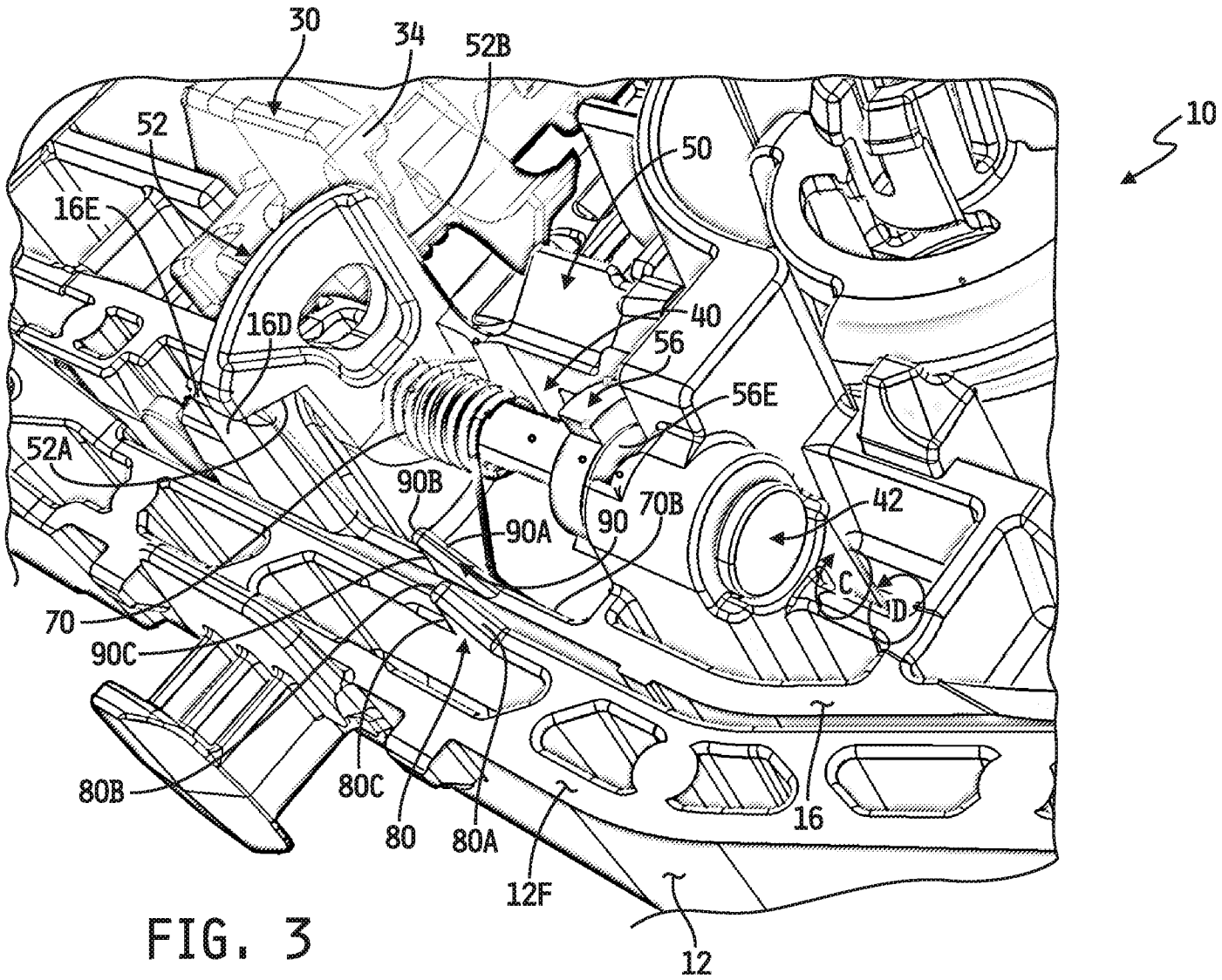
FIG. 3 is a perspective view of the resettable locking apparatus of FIG. 2 with the engagement coupler removed to illustrate reset structures formed on the carrier chassis and slidelock cassette.
Figure 4:
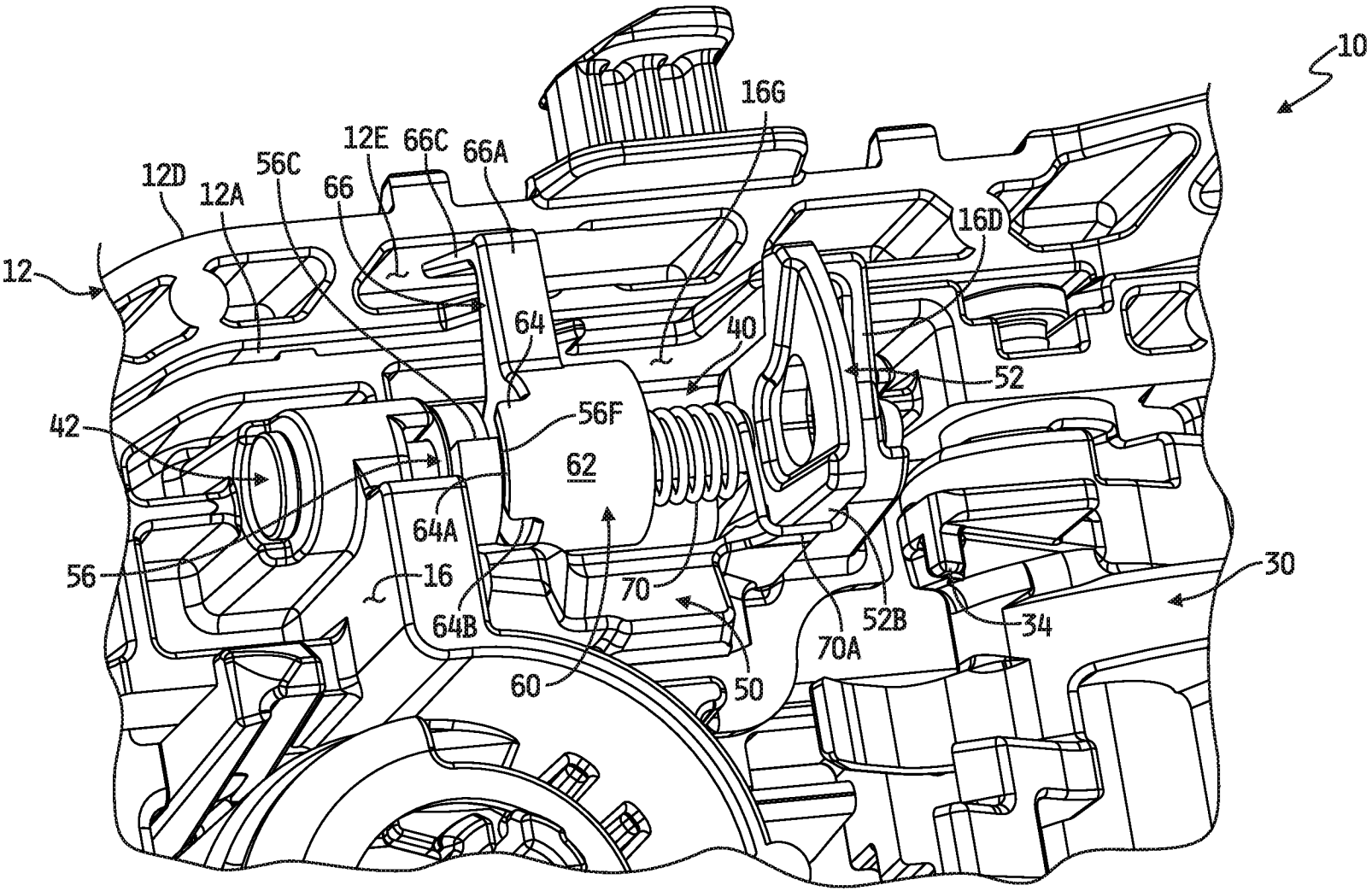
FIG. 4 is another perspective view of the resettable locking apparatus of FIG. 2 showing the bellcrank in an access closure latch mechanism actuating position.

The securement member 56 has an axial sidewall 56D which faces the engagement coupler 60 and an opposite sidewall 56E which faces a sidewall of the wall portion 16C of the slidelock cassette 16 (see, e.g., FIG. 3). A cam 56A extends radially away from a portion of an outer radial surface 56B of the securement member 56. A stepped cam surface 56C is defined between the outer radial surface of the cam 56A and the outer radial surface 56B of the securement member 56, and an axial sidewall 56F of the cam 56A faces the engagement coupler 60. In the illustrated embodiment, the axial sidewall 56F of the cam 56A is recessed into the cam 56A relative to the axial sidewall 56D of the securement member 56, although in alternate embodiments the axial sidewall 56F may be substantially co-planar with the axial sidewall 56D or made to extend past the axial sidewall 56D. In any case, the planar face of the cam surface 56C is illustratively substantially perpendicular to the surface of the axial sidewall 56D of the securement member 56.

The engagement coupler 60 illustratively includes a body portion 62 positioned on the spindle shaft 42B between the inertia lock member 52 and the securement member 56, and a radial leg 66 extending radially away from the body portion 62. The radial leg 66 illustratively has a radial portion 66A extending radially away from the body portion 62 of the engagement coupler 60, and a tab portion 66C extending downwardly from the radial portion 66A into a pocket 12E defined between the inner perimeter wall 12A and an outer perimeter wall 12D of the carrier chassis 12 (see, e.g., FIG. 4). An axial sidewall 62A of the engagement coupler 60 faces the opposing axial sidewall 56D of the securement member 56, and an axial leg 64 of the engagement coupler 60 extends axially away from the axial sidewall 62A of the body portion 62 toward the securement member 56. In the positions of the securement member 56 and engagement coupler 60 illustrated in FIGS. 1-5, an axial sidewall 64A of the axial leg 64 engages the axial sidewall 56F of the cam 56A (see, e.g., FIG. 4). The axial leg 64 further defines a stepped surface 64B at one end thereof (see, e.g., FIGS. 4 and 5) between top and bottom surfaces thereof, and a plane defined by the stepped surface 64B is illustratively substantially parallel with a plane defined by the axial sidewall 64A of the axial leg 64.

A biasing member 70 is coupled to and between the inertia lock member 52 and the slidelock cassette 16. The biasing member 70 illustratively applies a rotational biasing force to and between the slidelock cassette 16 and the inertia lock member 52, as well as an axial biasing force to and between the inertia lock member 52 and the engagement coupler 60. In the illustrated embodiment, the biasing member 70 is provided in the form of a single coil torsion and compression spring 70 having one end 70A coupled to one side 52B of the inertia lock member 52 (see FIG. 4) and an opposite end 70B coupled to the slidelock cassette 16 (see FIG. 3), although in alternate embodiments the biasing member 70 may be provided in the form of two or more such coil springs, one or more other conventional biasing mechanisms or any combination thereof. Examples of such other conventional biasing mechanisms may include, but are not limited to, one or more extension springs, one or more constant force springs, one or more spring clips, one or more flat springs, one or more resilient arms, tabs or protuberances, or the like. In any case, biasing member 70 is under torsion between the inertia lock member 52 such that a radial biasing force of the biasing member 70 is applied between the slidelock cassette 16 and the inertia lock member 52 which operates to rotationally bias the inertia lock member 52, and thus the entire inertia-activated member 50 including the securement member 56, in a counterclockwise D about and relative to the spindle shaft 42B as illustrated most clearly in FIG. 3. The biasing member 70 is also under compression between the inertia lock member 52 and the engagement coupler 60 such that an axial biasing force of the biasing member 70 applied between the inertia lock member 52 and the engagement coupler 60 which operates to force the engagement coupler 60 axially toward the securement member 56. In the default state of the inertia lock assembly 10 illustrated in FIGS. 1-5, the biasing member 70 acts to bias the axial sidewall 64A of the axial leg 64 into engagement with the axial sidewall 56F of the cam 56A of the securement member 56 (see, e.g., FIG. 4).

As most clearly shown in FIGS. 2 and 3, a first reset structure 80 extends upwardly from a top surface 12F of the carrier chassis 12, and a second reset structure 90 extends upwardly from a top surface 16F of the slidelock cartridge 16. The reset structures 80, 90 are proximate to one another but longitudinally offset from one another, i.e., spaced apart along a length of the inertia lock assembly 10, with the reset structures 80 positioned closer to the end 12B of the carrier chassis 12 such that the reset structure 80 is positioned between the end 12B of the carrier chassis 12 and the reset structure 90. In the illustrated embodiment, both reset structures 80, 90 are provided in the form of ramps defining linear ramped surfaces on one side thereof and a vertical step on the opposite side thereof. It will be understood, however, that such reset ramps are provided only by way of example, and that other structures and/or structural shapes may be implemented in alternative embodiments. Moreover, whereas two such reset ramps 80, 90 are illustrated in the figures and described below, it will be understood that alternate embodiments may include more or fewer such structures.

As most clearly illustrated in FIG. 3, the reset ramp 80 has ramp surface 80A which rises linearly from the top surface 12F of the carrier chassis 12 to a ramp peak 80B extending above the top surface 12F, and a step surface 80C which drops vertically from the ramp peak 80A back to the top surface 12F of the carrier chassis 12. The reset ramp 90 likewise has a ramp surface 90A which rises linearly from the top surface 16F of the slidelock cassette 16 to a ramp peak 90B extending above the top surface 16F, and a step surface 90C which drops vertically from the ramp peak 90A back to the top surface 16F of the slidelock cassette 16. In the illustrated embodiment, the ramp surfaces 80A, 90A extend in the same direction, i.e., linearly increasing in the direction A, although other embodiments are contemplated in which one or both of the ramp surfaces 80A, 90A increase or decrease linearly or non-linearly in any direction. The ramp peaks 80B, 90C illustratively raise to approximately the same relative height, although other embodiments are contemplated in which the height of the ramp peak 80B is greater or less than the height of the ramp peak 90B or vice versa. Illustratively the reset ramp 80 is integral with the carrier chassis 12 such that the two are of unitary construction, although alternate embodiments are contemplated in which the reset ramp 80 is separate from but suitably mounted or attached to the carrier chassis 12. Likewise, the reset ramp 90 is illustratively integral with the slidelock cassette 16 such that the two are of unitary construction, although alternate embodiments are contemplated in which the reset ramp 90 is separate from but suitably mounted or attached to the slidelock cassette 16.

As most clearly illustrated in FIG. 2, the bottom surface 66B of the radial portion 66A of the radial leg 66 is in contact with, or otherwise positioned over, the peak 80B of the reset ramp 80 in the default state and position of the inertia lock assembly 10. As described above with respect to FIG. 1, the carrier chassis 12 and the slidelock cassette 16 are movable relative to one another along the directions A, B, and such movement, in turn, causes the reset ramps 80 and 90 to also move relative to one another along the directions A, B. Such relative movement between the reset ramps 80, 90 illustratively acts on the radial leg 66 of the engagement coupler to effect resetting of the inertia lock assembly 10 as will be described in detail below with respect to FIGS. 10-15.

Contact between the bottom surface 66B of the radial portion 66A of the radial leg 66 and the peak 80B of the reset ramp 80 illustratively serves as a stop to any counterclockwise rotation (i.e., in the direction D as illustrated in FIG. 3) of the engagement coupler 60 about the spindle shaft 42B in the default position of the inertia locking assembly 10. As described above, the rotational biasing force of the biasing member 70 applied between the slidelock cassette 16 and inertia lock member 52 causes the inertia lock member 52, as well as the securement member 56, to rotate in the counterclockwise direction about the spindle shaft 42B. As illustrated most clearly in FIGS. 2 and 3, such counterclockwise rotation of the inertial lock member 52 causes the side 52A of the inertia lock member 52, opposite the side 52B which engages one end 70A of the biasing member 70, to contact a top surface 16E of the wall portion 16D of the slidelock cassette 16. In this position, which may be referred to herein as the "home" position of the inertia lock member 52 (which is also the default position or state of the inertia lock assembly 10), the top surface 16E of the wall portion 16D of the slidelock cassette 16 serves as a stop to the counterclockwise rotation of the inertia lock member 52, and thus of the inertia-activated member 50 generally, about the spindle 42 under rotational bias of the biasing member 70 (see, e.g., FIG. 3).

Figure 5:
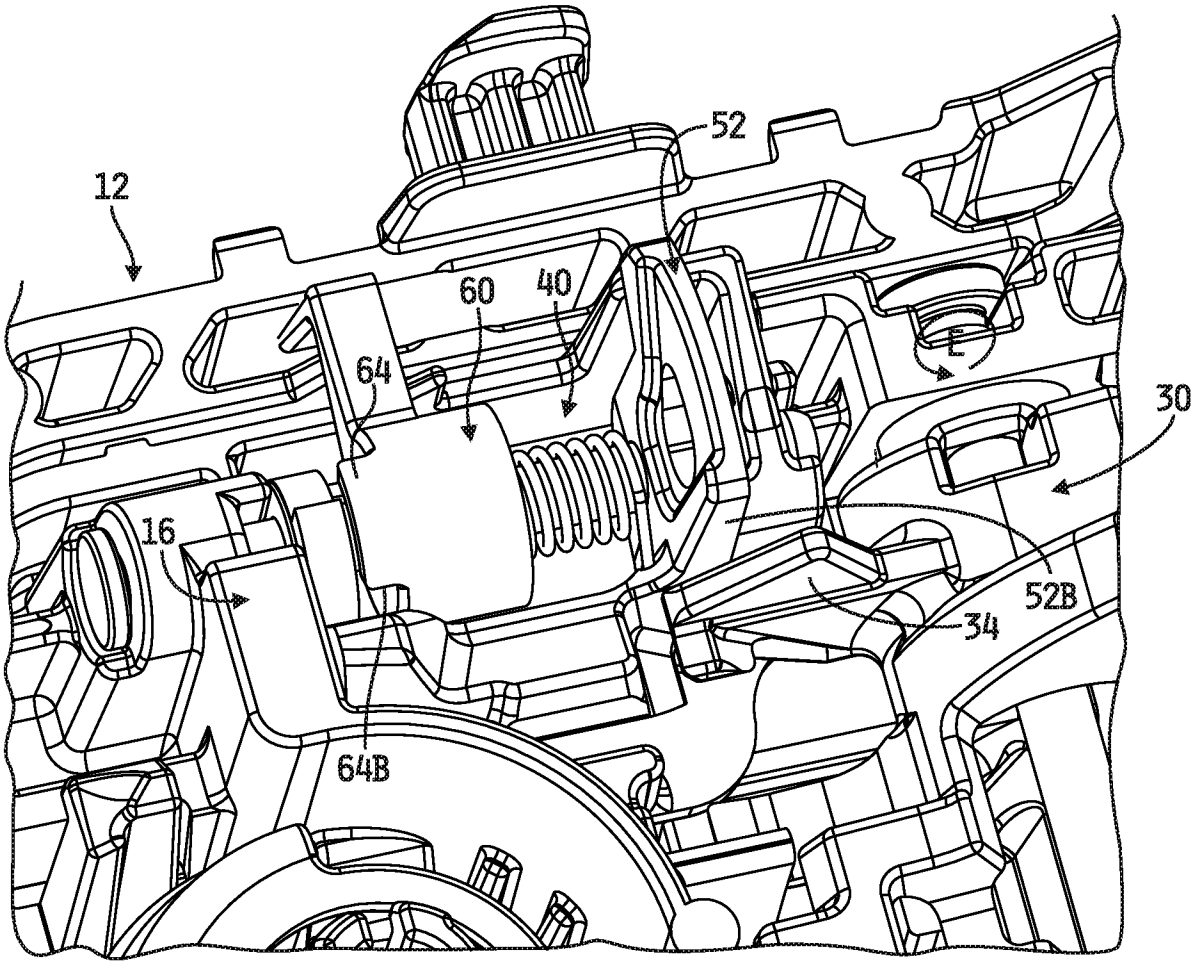
FIG. 5 is a perspective view similar to FIG. 4 and showing the bellcrank rotated, unimpeded by the resettable locking apparatus, to an access closure latch mechanism actuating position.

With the inertia lock member 52 in the home position, the inertia lock assembly 10 is in its default state as described above. In this default state, which is the home position of the inertia lock member 52 (and also of the inertia-activated member 50 as well as that of the resettable locking apparatus 40), the inertial lock member 52 does not impede rotational motion of the bellcrank 30 to its unlatching position. In the home position of the inertia-activated member, the bellcrank 30 is thus operable to actuate, e.g., engage and rotate, the latch mechanism of the access closure of the motor vehicle upon rotation of the bellcrank 30 to its unlatching position. Referring specifically to FIG. 5, for example, the bellcrank 30 is shown fully rotated in the clockwise direction E (as viewed from the orientation of the assembly 10 illustrated in FIG. 1) about and relative to the bellcrank spindle 32 to the unlatching position in which it which will actuate, e.g., engage and rotate or otherwise move, the latch mechanism of the access closure of the motor vehicle (not shown) to an unlatched position to allow the access closure to be opened. As illustrated in FIG. 5, the home position of the inertia lock member 52 avoids contact of the inertia lock member 52 with a leg 34 of the bellcrank which allows the bellcrank 30 to be fully rotated to the illustrated unlatching position.

Inertia Locking of the Inertia Locking Assembly

Figure 6:
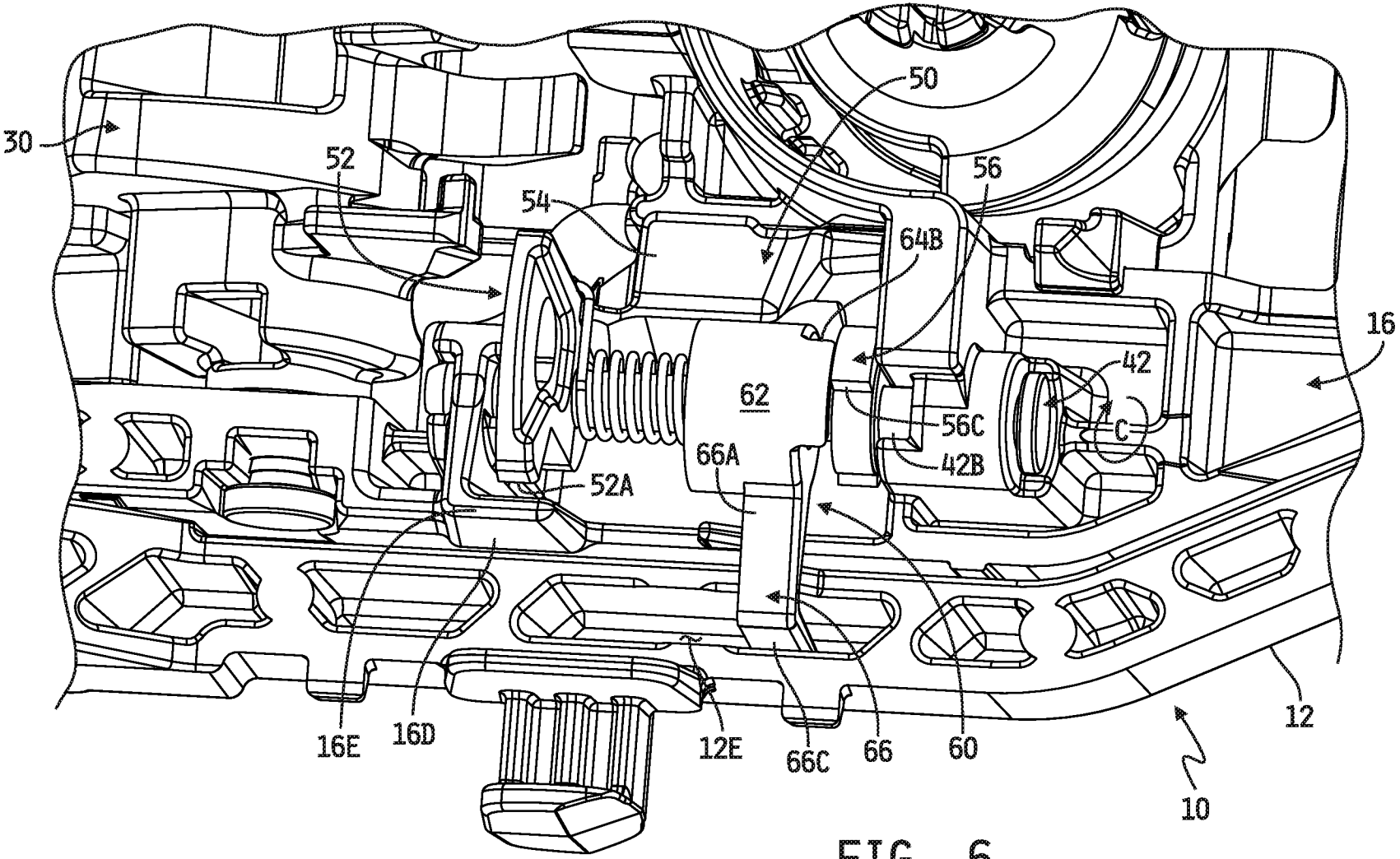
FIG. 6 is a perspective view of the inertia lock assembly subject to acceleration as a result of an impact event in which the inertia lock member has rotated away from its home position illustrated in FIGS. 1-5.
Figure 7:
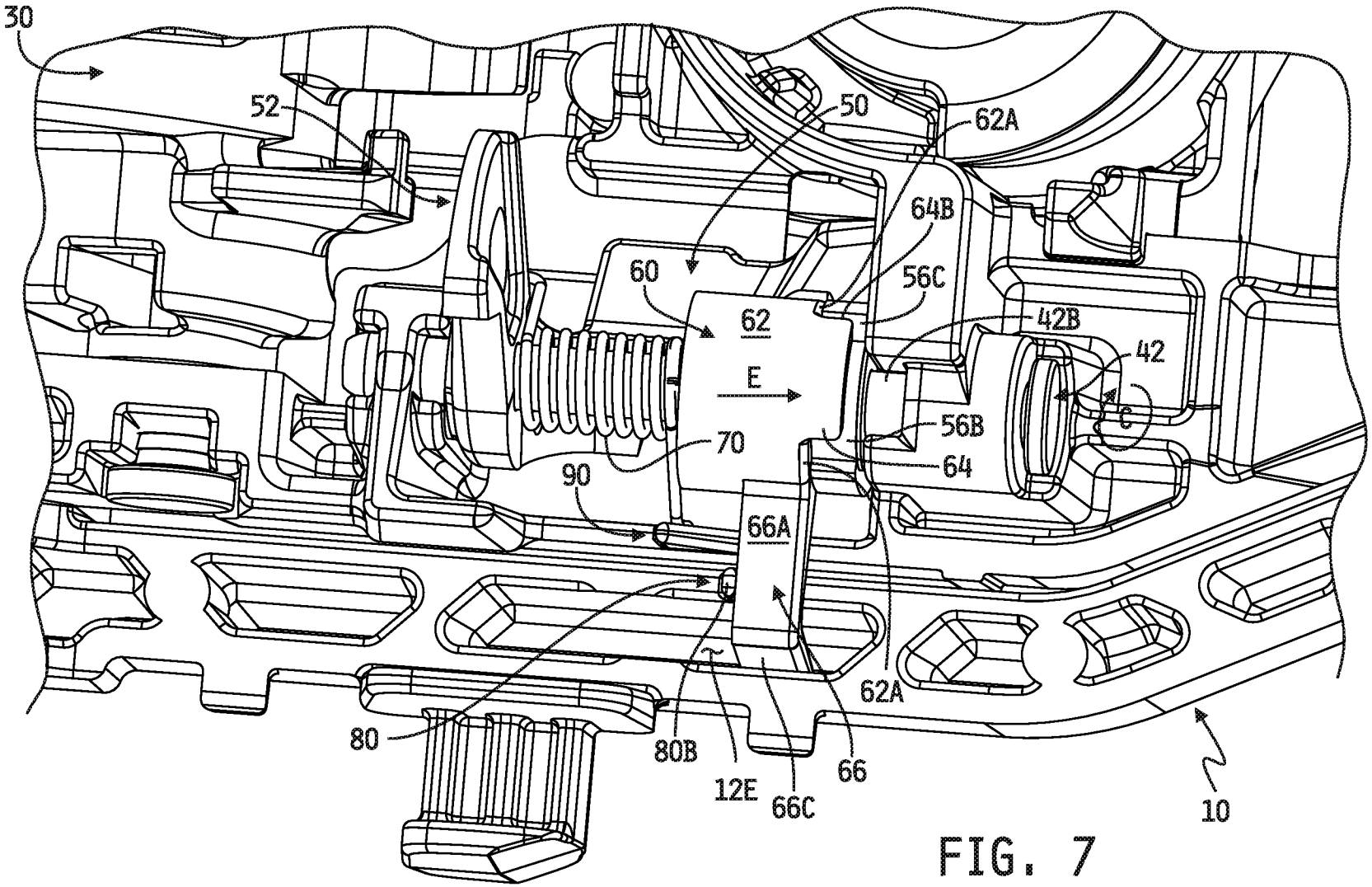
FIG. 7 is a perspective view of the inertia lock assembly still subject to acceleration as a result of the impact event in which the inertia lock member has rotated to further away from the home position illustrated in FIG. 6 to an initial inertia-activated position of the resettable locking apparatus.
Figure 8:
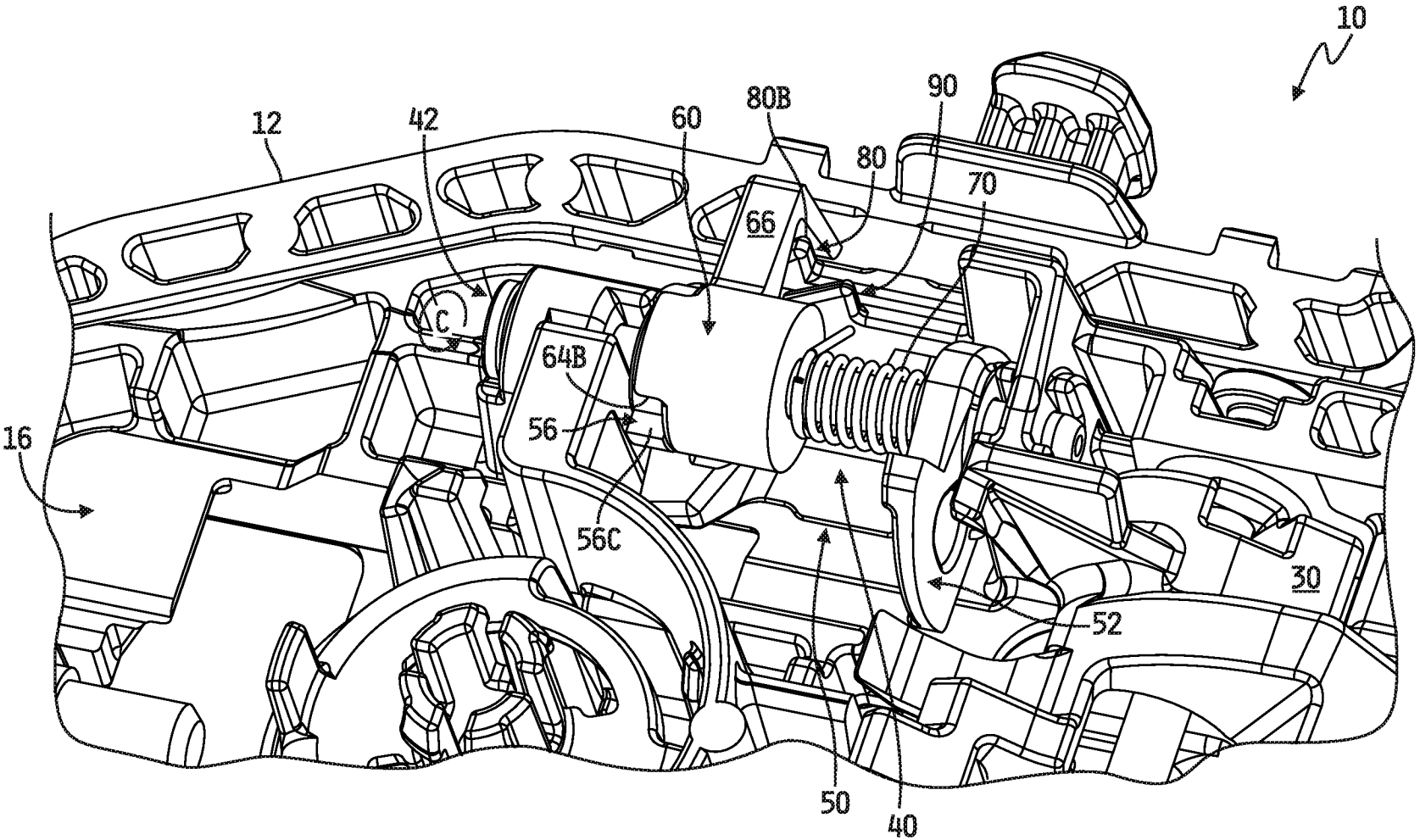
FIG. 8 is a perspective view of the inertia lock assembly still subject to acceleration as a result of the impact event in which the inertia lock member has rotated still further away from the home position illustrated in FIG. 6.

Upon the application of an acceleration force, e.g., during a vehicle impact event, the inertia-activated member 50 is driven by the acceleration force to rotate in the clockwise direction C about the spindle shaft 42 to, and beyond, an inertia-activated position in which the inertia lock member 52 blocks rotation of the bellcrank 30 to the unlatching position described above so that the bellcrank 30 cannot engage the latch mechanism of the access closure of the motor vehicle. In any such inertia-activated position, the inertia-activated member 50, and the inertia lock member 52 in particular, blocks full rotation of the bellcrank 30 and thus prevents actuation of the latch mechanism of the access closure and, in turn, prevents the access closure from being opened. Although not specifically illustrated in the Figures, the inertia lock assembly 10 is illustratively mounted to or within the access closure and oriented relative to the access closure such that acceleration forces resulting from impacts to the access closure will cause the inertia-activated member 50, and the inertia lock member 52 specifically, to rotate in the clockwise direction C as illustrated in FIGS. 6-8. Those skilled in the art will recognize that in other implementations, the inertia lock assembly 10 may be suitably oriented relative to one or more structures so as to cause the inertia-activated member 50, and the inertia lock member 52 in particular, to rotate in the counterclockwise direction in response to acceleration forces resulting from impacts to such one or more structures.

Referring specifically to FIG. 6, the inertia-activated member 50, and the inertia lock member 52 in particular, has rotated against the biasing force of the biasing member 70 approximately 30 degrees in the clockwise direction from the home position (illustrated in FIGS. 1-5) in response to an acceleration force resulting from an impact event. The sidewall(s) of the pocket 12E in the carrier chassis 12 illustratively engage the tab portion 66C of the radial leg 66 extending from the engagement coupler 60, thereby limiting rotation of the body portion 62 of the engagement coupler 60 in the clockwise direction C about the spindle shaft 42B. As a result of the clockwise rotation of the inertia-activated member 50, the cam surface 56C of the securement member 56 has rotated in the clockwise direction toward the stepped surface 64B of the axial leg 64 of the engagement coupler 60. In the operating state illustrated in FIG. 6, the inertia lock member 52 has not rotated sufficiently clockwise to an inertia-activated position which will contact the leg 34 of the bellcrank 30 if the bellcrank 30 is rotatably actuated toward the latch mechanism of the access closure. Consequently, with the inertia lock member 52 rotated approximately 30 degrees away from the home position as illustrated in FIG. 6, the bellcrank 30 is still fully rotatable to a position which will engage and move the latch mechanism of the access closure of the motor vehicle (not shown) to an unlatched position to allow the access closure to be opened.

Referring now to FIG. 7, the inertia-activated member 50, and the inertia lock member 52 in particular, has rotated against the biasing force of the biasing member 70 another 30 degrees from the position illustrated in FIG. 6, i.e., to approximately 60 degrees in the clockwise direction C from the home position, in response to the acceleration force resulting from the impact event. The sidewall(s) of the pocket 12E in the carrier chassis 12 continue to engage the tab portion 66C of the radial leg 66 extending from the engagement coupler 60, thereby limiting rotation of the body portion 62 of the engagement coupler 60 in the clockwise direction C about the spindle shaft 42B. As a result of the clockwise rotation of the inertia-activated member 50, the cam surface 56C of the securement member 56 has rotated in the clockwise direction to, and has slightly cleared or moved past, the stepped surface 64B of the axial leg 64 of the engagement coupler 60.

As the axial sidewall 56F of the cam 56A no longer axially constrains the axial sidewall 64A of the axial leg 64 of the engagement coupler 60, the axial force of the biasing member 70 acting between the inertia lock member 52 and the engagement coupler 60 forces the engagement coupler 60 to move linearly along the spindle shaft 42B in the direction E illustrated in FIG. 7, i.e., in a direction toward the securement member 56, such that the axial leg 64 is received over the outer radial surface 56B of the securement member 56. Such axial movement of the engagement coupler 60 in the direction E ceases when the axial sidewall 62A of the engagement coupler 60 is forced, by the axial biasing force of the biasing member 70, into engagement with the axial sidewall 56D of the securement member 56 with the stepped surface 64B of the axial leg 64 facing the cam surface 56C of the securement member cam 56A. The total linear distance moved by the engagement coupler 60 is illustratively equal to the thickness of the axial leg 64, i.e., the distance between the surface of the axial sidewall 64A of the axial leg 64 and the axial sidewall 62A of the engagement coupler body member 62. In one example embodiment, this distance (and thickness) is approximately 2 millimeters (mm), although in alternate embodiments this distance (and thickness) may be less than 2 mm or greater than 2 mm.

Axial movement of the axial leg 64 of the engagement coupler 60 over the external radial surface 56B of the securement member 56 moves the stepped surface 64B of the axial leg 64 into the rotational path of the cam surface 56C of the securement member 56 as illustrated in FIG. 7, which illustratively represents an initial engagement position of the inertia-activated member 50 with the engagement coupler 60. Regardless of any further rotational movement of the inertia-activated member 50, clockwise or counterclockwise, the stepped surface 64B of the axial leg 64 will at some point following, or nearing the end of, the acceleration phase of the impact event, engage the cam surface 56C of the securement member 56, thereby locking the inertia-activated member 50 in a final locked or engaged position as described in greater detail below. As the stepped surface 64B and the cam surface 56C will eventually come into contact with each other, each may be referred to herein as an engagement surface.

Referring now to FIG. 8, the inertia-activated member 50, and the inertia lock member 52 in particular, has rotated against the biasing force of the biasing member 70 another 30 degrees from the position illustrated in FIG. 7, i.e., to approximately 90 degrees in the clockwise direction C from the home position, in response to the acceleration force resulting from the impact event. The sidewall(s) of the pocket 12E in the carrier chassis 12 continue to engage the tab portion 66C of the radial leg 66 extending from the engagement coupler 60, thereby limiting rotation of the body portion 62 of the engagement coupler 60 in the clockwise direction C about the spindle shaft 42B. As a result of the clockwise rotation of the inertia-activated member 50, the cam surface 56C of the securement member 56 has rotated in the clockwise direction C past the stepped surface 64B of the axial leg 64 of the engagement coupler 60 to define a gap between the two surfaces 56C, 64B as illustrated in FIG. 8.

Figure 9:
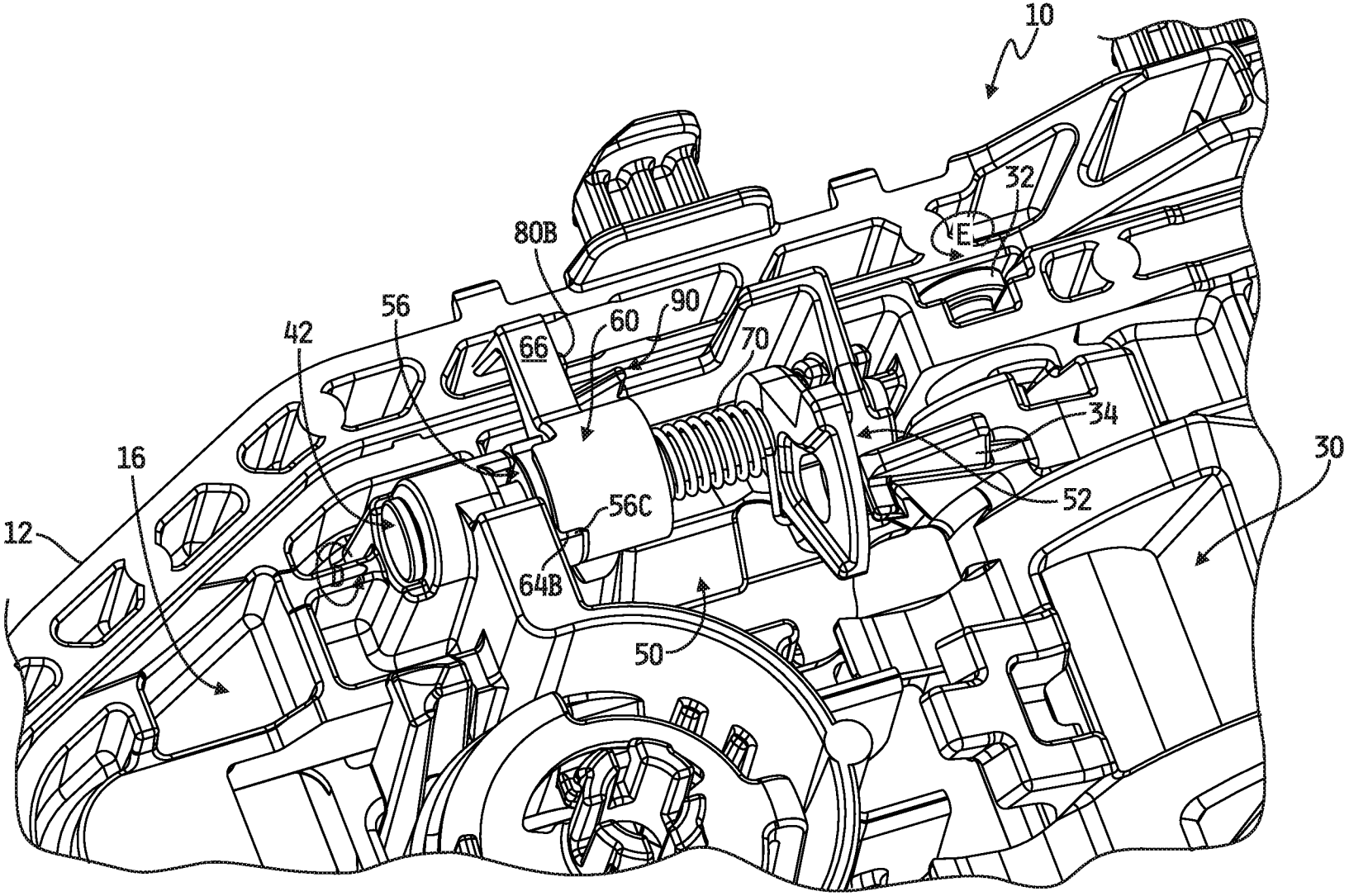
FIG. 9 is a perspective view of the inertia lock assembly as acceleration resulting from the impact event has dissipated, and in which the inertia lock member has, in response, rotated back from the position illustrated in FIG. 8 to a final inertia-activated locked position to block rotational actuation by the bellcrank of the access closure latch mechanism.

Referring now to FIG. 9, the acceleration phase of the impact event has dissipated, or has at least sufficiently dissipated, such that the inertia-activated member 50 is no longer driven by acceleration to rotate in the clockwise direction C. Rotationally assisted by the biasing force of the biasing member 70, the inertia-activated member 50 has therefore now rotated back in the counterclockwise direction D until the cam surface 56C of the cam 56A of the securement member 56 has come into contact with the stepped surface 64B of the axial leg 64 of the engagement coupler 60. The rotational biasing force of the biasing member 70 acting against the body member 62 of the engagement coupler 60 illustratively causes the body member 62 to rotate somewhat in the counterclockwise direction D as the tab portion 66C of the radial leg 66 extending from the engagement coupler 60 is forced into engagement with one of the wall surfaces of the carrier chassis 12 within the carrier chassis pocket 12E. Following such rotation of the combination of the inertia-activated member 50 and the engagement coupler 60 in the counterclockwise direction D, the inertia-activated member 50 is locked in the final engaged or locked position until it is reset as described below with respect to FIGS. 10-15.

In one embodiment, the position of the inertia lock member 52 in the final locked or engaged position of the inertia-activated member 50 is approximately 53 degrees from the home position. It will be understood that numerical values of the initial locked or engaged position of the inertia lock member 52 illustrated in FIG. 7 and the final locked or engaged position of the inertia lock member 52 illustrated in FIG. 9 of approximately 60 degrees and 53 degrees respectively from the home position are provided only by way of example, and that alternate embodiments are contemplated in which the initial locked or engaged position of the inertia lock member 52 is greater or less than 60 degrees and/or the final locked or engaged position of the inertia lock member 52 is greater or less than 53 degrees.

In any case, the inertia lock member 52, in the final locked position of the inertia-activated member 50, operatively blocks or prevents the bellcrank 30 from fully rotating to a position at which the bellcrank 30 can engage and move the latch mechanism of the access closure of the motor vehicle (not shown) to an unlatched position to allow the access closure to be opened. As illustrated in FIG. 9, for example, the inertia lock member 52 in the final locked position of the inertia-activated member 50 is positioned to contact and engage the leg 34 of the bellcrank 30 as the bellcrank 30 is rotated in the direction E, which prevents the bellcrank 30 from rotating sufficiently to engage and actuate the latch mechanism of the access closure. It is to be understood that any rotational position of the inertia lock member 52 that is greater than or equal to the final locked position, e.g., the initial locked position and any of the rotational positions including and between those illustrated in FIGS. 7 and 8, will likewise prevent the bellcrank 30 from fully rotating to its unlatching position at which the bellcrank 30 can actuate the latch mechanism of the access closure of the motor vehicle (not shown) to an unlatched position to allow the access closure to be opened. The inertia lock member 52 is thus operable to disable, i.e., block, the bellcrank 30 at all rotational positions of the inertia-activated member 50 allowed by the engagement coupler 60 after the inertia-activated member 50 has moved to the initial locked position illustrated in FIG. 7, until the resettable locking apparatus 40 is reset as described below with respect to FIGS. 10-15. In this regard, any such position of the inertia-activated member 50 in which the inertia lock member 52 blocks the bellcrank member 30 from fully rotating as just described may be referred to herein as an inertia-activated position.

As is apparent in the initial engagement position of the inertia-activated member 50 illustrated in FIG. 7, the axial movement of the engagement coupler 60 into the initial locked or engaged position with the securement member 56 of the inertia-activated member 50 has caused the radial leg 66 of the engagement coupler 60 to move in the direction E (i.e., in the direction toward the end 12B of the carrier chassis 12) past the peak 80B of the reset ramp 80. When the inertia-activated member 50 subsequently forces the engagement coupler 56 to rotate in the counterclockwise direction D under the rotational biasing force of the biasing member 70 to the final locked or engaged position of the inertia-activated member 50 illustrated in FIG. 9, this forces the bottom surface 66B of the radial leg 66 into and against the ramp portion 80A of the reset ramp 80, thereby blocking or impeding axial movement of the engagement coupler 60 back toward the inertia lock member 52, i.e., in the direction A, so as to avoid unintended reset of the inertia-activated member 50.

Resetting the Inertia Lock Assembly

The inertia lock assembly 10, and more particularly the resettable locking apparatus 40, may be reset to the home position of the inertia-activated member 50. This is illustratively accomplished by rotating the head 18A of the screw or bolt 18 such that the threaded shaft 18B rotating in the engagement clip(s) 20 pushes the slidelock cassette 16 linearly away from the end 12B of the carrier chassis 12 in the direction A to widen the gap 22 therebetween, as illustrated by example in FIG. 10. Such movement of the slidelock cassette 16 in the direction A illustratively forces the radial leg 66 of the engagement coupler 60 coupled to the slidelock cassette 16 to also move in the direction E. As the slidelock cassette 16 is linearly moved in the direction A away from the end 12B of the carrier chassis 12 in response to the manual rotational force applied to the head 18A of the screw or bolt 18, the bottom surface 66B of the radial portion 66A of the radial leg 66 of the engagement coupler 60 is forced up the ramp 80A of the reset ramp 80 and, eventually, past the peak 80B of the reset ramp 80.

As the slidelock cassette 16 is moved in response to rotational movement of the screw or bolt 18 to its maximum distance away from the end 12B of the carrier chassis 12, i.e., as the gap 22 increases to its maximum width, the bottom surface 66B of the radial portion 66A of the radial leg 66 of the engagement coupler 60 clears the peak 80B of the reset ramp 80. The rotational biasing force of the biasing member 70 applied by the cam surface 56C of the cam 56A of the securement member 56 to the stepped surface 64B of the axial leg 64 of the engagement coupler 60 then causes the combination of the inertia-activated member 50 and the engagement coupler 60 to rotate about the spindle 42 in the counterclockwise direction D. Such rotation of the inertial-activated member 50 and the engagement coupler 60 forces the radial portion 66A of the radial leg 66 downwardly toward and into contact with the top surface 12F of the carrier chassis 12 between the reset ramps 80 and 90 as the tab 66B extends downwardly into the chassis pocket 12E, as illustrated in FIG. 10. With the bottom surface 66B of the radial portion 66A of the radial leg 66 contacting the top surface 12F of the carrier chassis 12 between the reset ramps 80 and 90 as illustrated in FIG. 10, the gap 22 is at its maximum width. In one example embodiment, the inertia lock member 52 has, in the position of the inertia-activated member 50 and engagement coupler 60 illustrated in FIG. 10, rotated back to approximately 40 degrees from the home position, and it will be understood that other embodiments are contemplated in which the position of the inertia lock member 52 illustrated in FIG. 10 is greater or less than 40 degrees from the home position.

Figure 11:
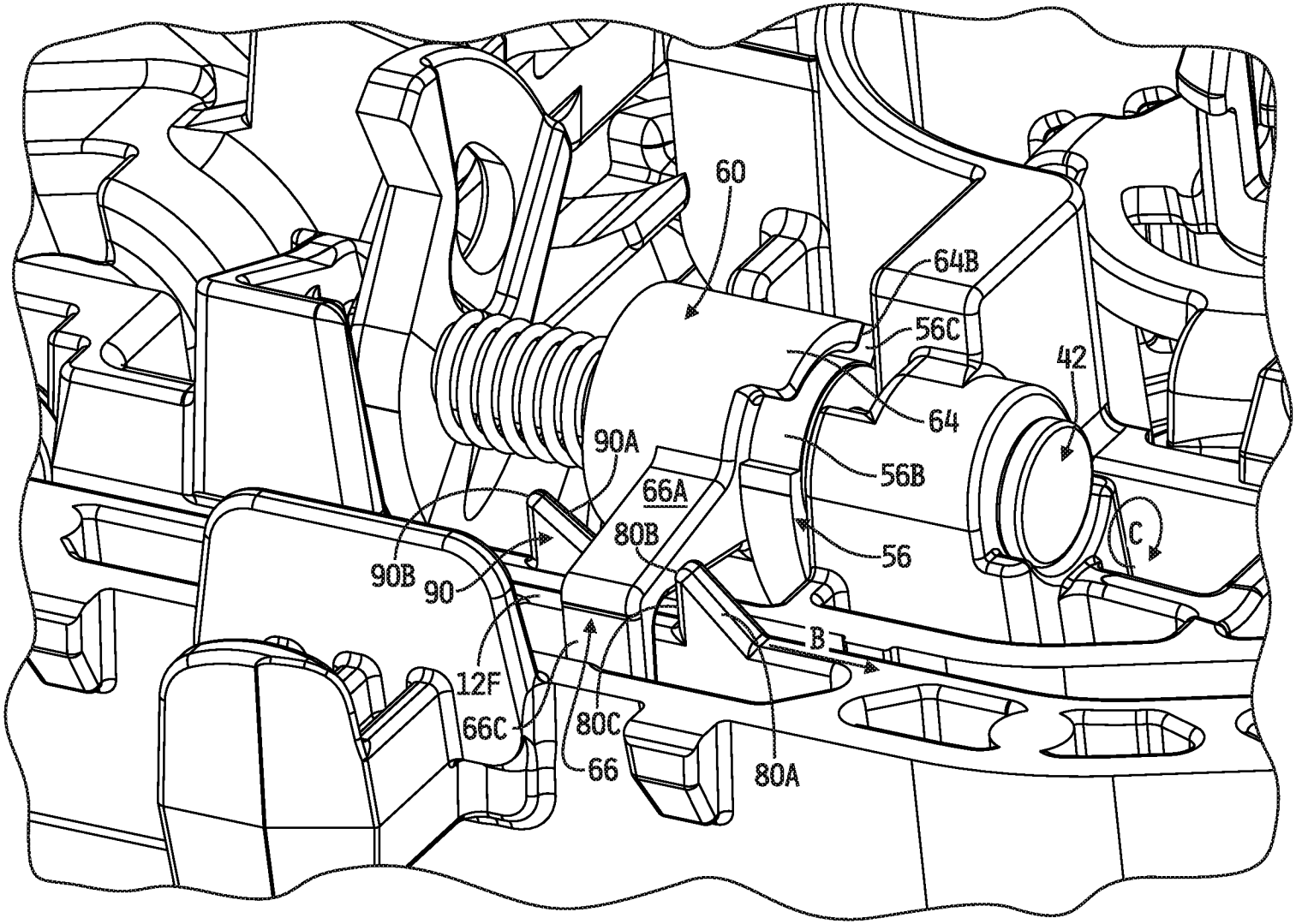
FIG. 11 is a magnified view of the resettable locking apparatus of the inertia lock assembly further in the process of resetting the resettable lock apparatus.

With the radial portion 66A of the radial leg 66 positioned between the reset ramps 80 and 90 as illustrated in FIG. 10, the rotational force applied to the head 18A of the screw or bolt 18 is reversed, thereby drawing the slidelock cassette 16 back toward the end 12B of the carrier chassis 12 along in the direction B as illustrated in FIG. 11. As also illustrated in FIG. 11, movement of the slidelock cassette 16 in the direction B toward the end 12B of the carrier chassis 12 causes the vertical step surface 80C of the reset ramp 80 to engage the radial leg 66 of the engagement coupler 60 and thereby block movement of the engagement coupler 60 in the direction E. This causes the engagement coupler 60 to axially separate from the securement member 56 against the axial force of the biasing member 70. As the slidelock cassette 16 moves in the direction B, the radial portion 66A of the radial leg 66 of the engagement coupler 60, being prevented by the vertical step surface 80C of the reset ramp 80 from movement in the direction B, is forced up the ramp surface 90A of the approaching reset ramp 90, thereby forcing the combination of the engagement coupler 60 and the inertia-activated member 50 to rotate about the spindle 42 in the clockwise direction C as the engagement coupler 60 is forced to axially separate from the securement member 56.

Figure 12:
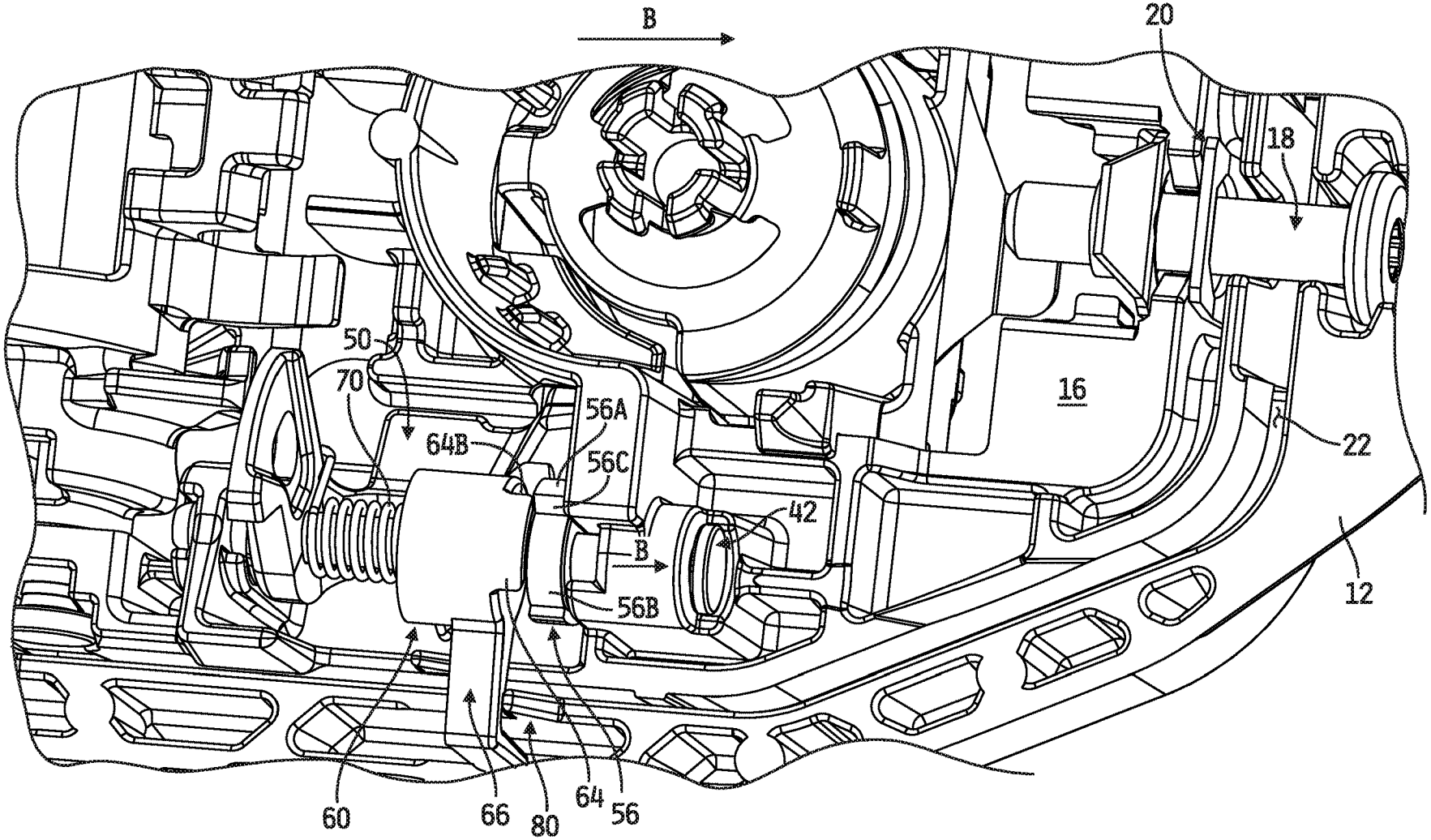
FIG. 12 is a perspective view of the inertia lock assembly still further in the process of resetting the resettable lock apparatus.

Continued drawing of the slidelock cassette 16 back toward the end 12B of the carrier chassis 12 along in the direction B eventually causes the vertical step surface 80C of the reset ramp 80 acting on the radial leg 66 to force the stepped surface 64B of the axial leg 64 of the engagement coupler 60 axially away from, and out of engagement with, the cam surface 56C of the cam 56A of the securement member 56, as illustrated in FIG. 12. Just before this occurs, the radial portion 66A of the radial leg 66 of the engagement coupler 60 has been forced sufficiently along and up the ramp 90A of the reset ramp 90 to cause the combination of the engagement coupler 60 and the inertia-activated member 50 to further rotate about the spindle 42 in the clockwise direction C. Illustratively, the maximum rotation of the combination of the engagement coupler 60 and the inertia-activated member 50 about the spindle 42 in the clockwise direction C during this phase of the manual reset is approximately 10 degrees, thereby placing the inertia lock member 52 at approximately 50 degrees from the home position. It will be understood, however, that these numerical values are provided only by way of example, and that other embodiments are contemplated in which maximum rotation of the combination of the engagement coupler 60 and the inertia-activated member 50 about the spindle in the clockwise direction C during this phase of the manual reset is greater or less than 10 degrees and/or in which the inertia lock member 52 is more or less than 50 degrees from the home position.

Figure 13:
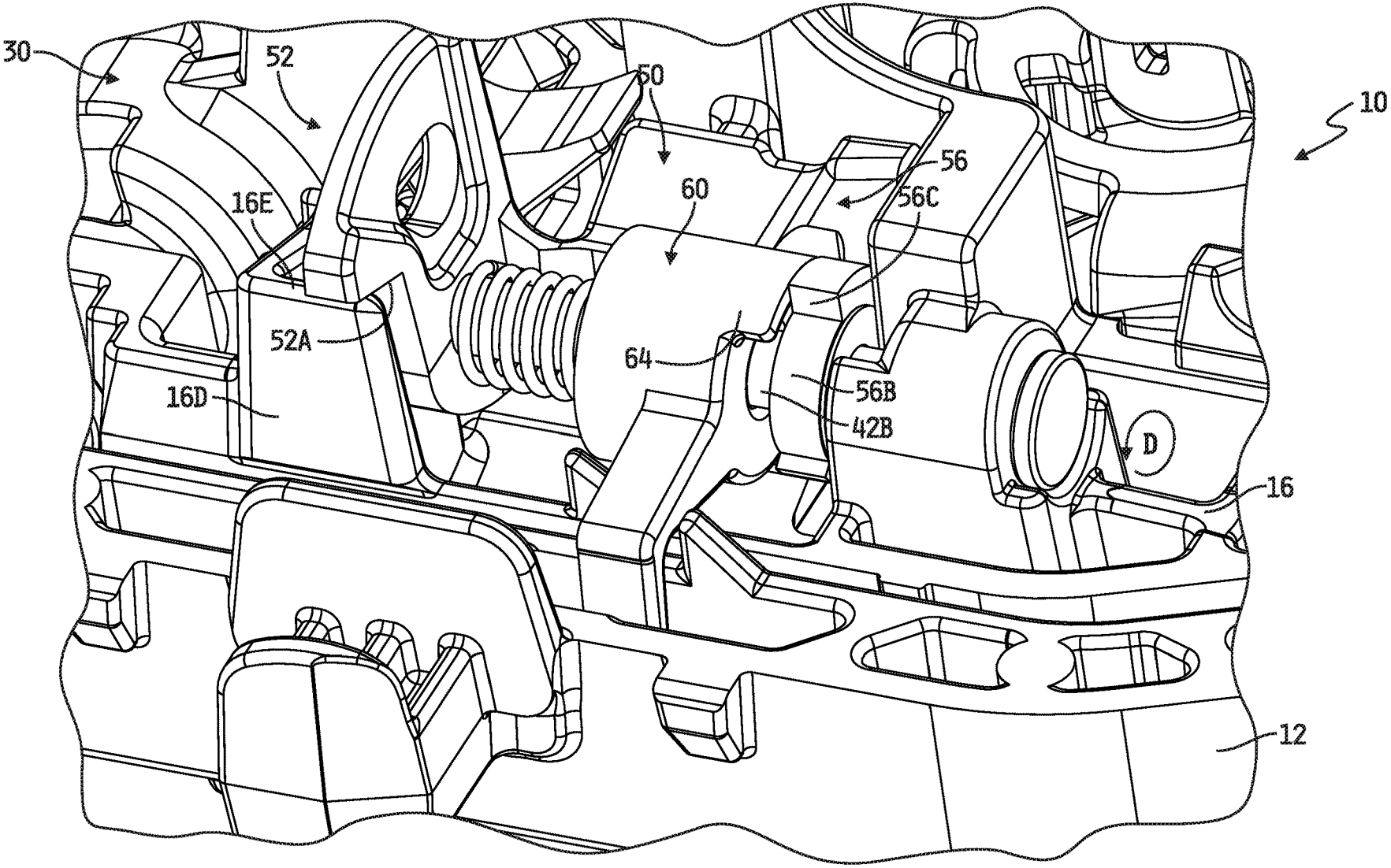
FIG. 13 is a perspective view of the inertia lock assembly still further in the process of resetting the resettable lock apparatus with the inertia lock member returned to its home position.

In any case, when the stepped surface 64B of the axial leg 64 of the engagement coupler 60 axially clears the cam surface 56C of the cam 56A of the securement member 56, rotation of the inertia-activated member 50 in the counterclockwise direction D about the spindle shaft 42B is no longer constrained by the engagement coupler 60, and the inertia-activated member 50 therefore rotates, in the counterclockwise direction D about and relative to the spindle shaft 42B in response to the rotational bias of the biasing member 70 acting on the inertia-activated member 50, back to the home position as illustrated in FIG. 13.

Figure 14:
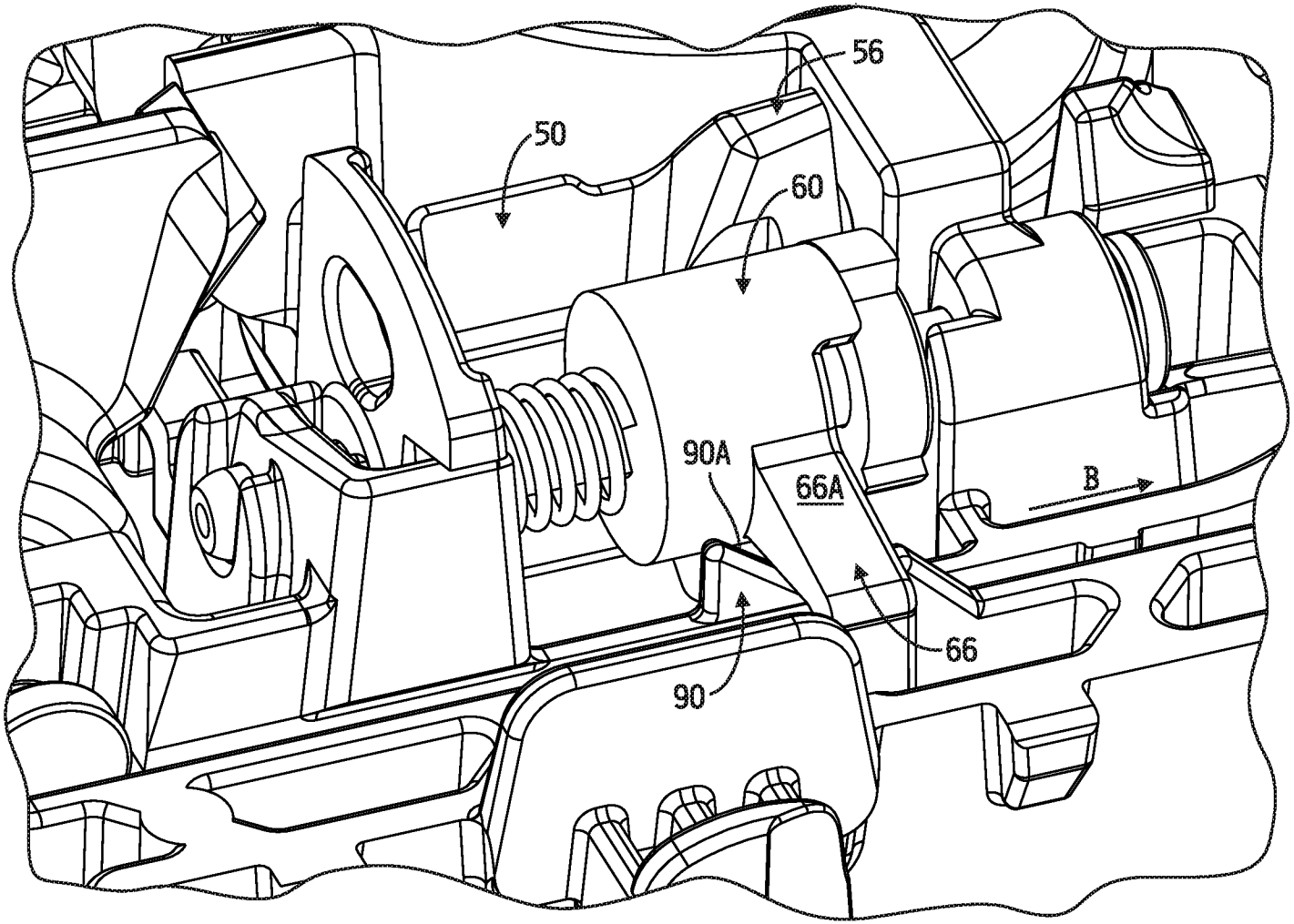
FIG. 14 is a perspective view of the inertia lock assembly yet further in the process of resetting the resettable lock apparatus and showing the engagement coupler being repositioned over one of the reset structures.
Figure 15:
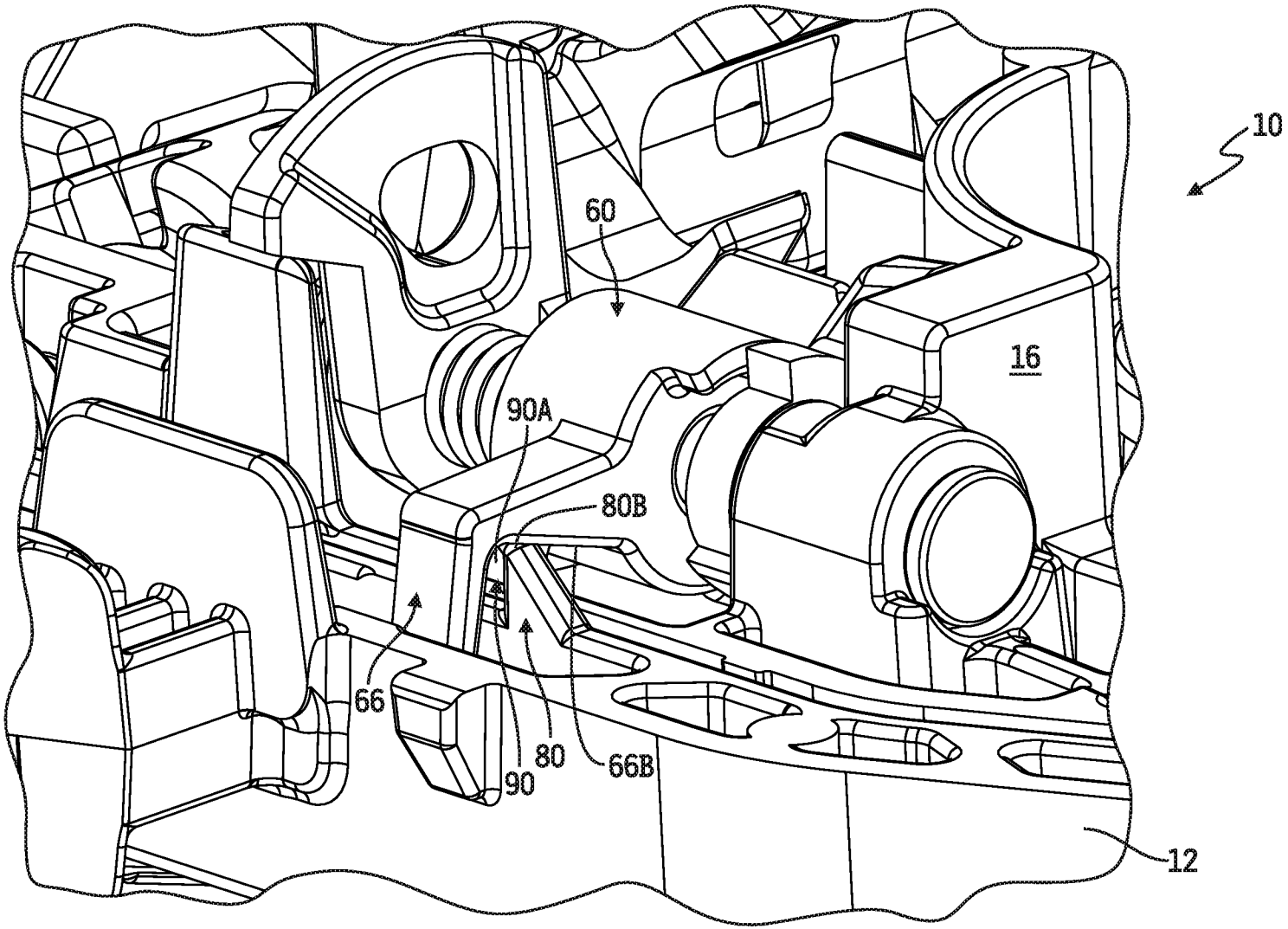
FIG. 15 is a magnified perspective view of the resettable lock apparatus in the same operational state as that of FIG. 14 further illustrating repositioning of the engagement coupler over one of the reset structures.

Continued drawing of the slidelock cassette 16 back toward the end 12B of the carrier chassis 12 along in the direction B continues to force the radial portion 66A of the radial leg 66 of the engagement coupler 60 up the ramped surface 90A of the reset ramp 90 as illustrated in FIG. 14. As the outer perimeter wall 16A of the slidelock cassette 16 approaches the inner perimeter wall 12A of the carrier chassis 12 adjacent to the end 12B of the carrier chassis 12, the bottom surface 66B of the radial portion 66A of the radial leg 66 of the engagement coupler 60 has been raised by ramped surface 90A of the reset ramp 90 sufficiently to clear the peak 80B of the reset ramp 80, as best illustrated in FIG. 15. Further drawing of the slidelock cassette 16 toward the end 12B of the carrier chassis 12 locates the bottom surface 66B of the radial portion 66A of the radial leg 66 of the engagement coupler over the peak 80B of the reset ramp 80 as described with respect to FIGS. 1 and 2, thus completing reset of the resettable locking apparatus 40 to the home position of the inertia-activated member 50.

While the concepts of this disclosure have been illustrated and described in detail in the foregoing drawings and description, the same is to be considered as illustrative and not restrictive in character, it being understood that only illustrative embodiments thereof have been shown and described and that all changes and modifications that come within the spirit of this disclosure are desired to be protected.

What is claimed is:

1. A resettable inertia lock assembly, comprising:

a chassis configured to be mounted within an access closure of a motor vehicle, a cassette configured to be slidably mounted to the chassis, a reset structure defined on one of the chassis and the cassette, a spindle mounted to the cassette, a resettable locking apparatus operatively mounted to the cassette, the resettable locking apparatus including an inertia-activated member and an engagement coupler, the inertia-activated member rotatably mounted to the spindle and responsive to an acceleration force to rotate relative to the spindle from a home position to an inertia-activated position, the engagement coupler mounted to the spindle and axially movable under bias along the spindle to a first position in which the engagement coupler engages and secures the inertia-activated member in the inertia-activated position, and a movement device for producing a relative movement between the chassis and the cassette to cause the reset structure to engage and move the engagement coupler from the first position to a second position in which the engagement coupler disengages from the inertia-activated member whereupon the inertia-activated member rotates under bias relative to the spindle to reset the inertia-activated member from the inertia-activated position to the home position.

2. The assembly of claim 1, further comprising a bellcrank rotatably coupled to the cassette and configured to actuate a latch mechanism of the access closure upon rotation of the bellcrank to an unlatching position to allow the access closure to be opened, wherein the inertia-activated member in the inertia-activated position blocks rotation of the bellcrank to the unlatching position to prevent actuation of the latch mechanism, and wherein the inertia-activated member in the home position does not block rotation of the bellcrank to the unlatching position.

3. The assembly of claim 1, further comprising a biasing member operatively coupled to the inertia-activated member, the biasing member biasing the inertia-activated member to the home position when the engagement coupler is moved by the reset structure from the first position to the second position thereof.

4. The assembly of claim 1, further comprising a biasing member operatively coupled to the inertia-activated member, the biasing member configured to apply a rotational biasing force to the inertia-activated member to rotate the inertia-activated member relative to the spindle to the home position when the engagement coupler is moved by the reset structure from the first position to the second position thereof.

5. The assembly of claim 4, wherein the biasing member is further coupled to the engagement coupler, and wherein the biasing member is further configured to apply an axial biasing force to the engagement coupler to force the engagement coupler toward the first position thereof.

6. The assembly of claim 1, wherein the engagement coupler comprises a body member and a radial leg extending radially away from the body member, wherein the body member of the engagement coupler defines a first engagement surface and the inertia-activated member defines a second engagement surface, wherein, in the first position of the engagement coupler, the first engagement surface engages the second engagement surface to secure the inertia-activated member in the inertia-activated position, and wherein the reset structure engages the radial leg of the engagement coupler to move the engagement coupler from the first to the second position thereof.

7. A resettable inertia lock assembly, comprising:

a chassis configured to be mounted within an access closure of a motor vehicle, a cassette configured to be slidably mounted to the chassis, a spindle mounted to the cassette, a resettable locking apparatus operatively mounted to the cassette, the resettable locking apparatus including an inertia-activated member and an engagement coupler, the inertia-activated member rotatably mounted to the spindle and responsive to an acceleration force to rotate relative to the spinde from a home position to an inertia-activated position, the engagement coupler mounted to the spindle and axially movable under bias along the spindle to a first position in which the engagement coupler engages and secures the inertia-activated member in the inertia-activated position, and a reset structure defined on one of the chassis and the cassette, the reset structure defining a ramp extending away from a surface of the one of the chassis and the cassette, the ramp surface engaging a portion of the engagement coupler in the first position of the engagement coupler to inhibit movement of the engagement coupler from the first position to a second position in which the engagement coupler disengages from the inertial-activated member.

8. The assembly of claim 7, wherein the ramp of the reset structure extends from the surface of the one of the chassis and the cassette on one side of the reset structure to a peak, and wherein the reset structure further defines a step extending from the first peak back to the surface of the one of the chassis and the cassette on an opposite side of the reset structure, and further comprising a movement device for producing a relative movement between the chassis and the cassette along a first direction to move the portion of the engagement coupler along the ramp to and beyond the peak to the opposite side of the reset structure.

9. The assembly of claim 8, further comprising at least one biasing member for biasing the portion of the engagement coupler toward the surface of the one of the chassis and the cassette, the at least one biasing member biasing the portion of the engagement coupler toward the surface of the one of the chassis and the cassette adjacent to the opposite side of the reset structure when the relative movement between the chassis and the cassette along the first direction causes the portion of the engagement member to clear the peak of the reset structure.

10. The assembly of claim 8, wherein the movement device is actuatable to produce a relative movement between the chassis and the cassette along a second direction opposite the first direction to cause the step of the reset structure to engage the portion of the engagement coupler and move the engagement coupler from the first position to the second position whereupon the inertia-activated member rotates under bias relative to the spindle to reset the inertia-activated member from the inertia-activated position to the home position.

11. The assembly of claim 10, further comprising a biasing member operatively coupled to the inertia-activated member, the biasing member biasing the inertia-activated member to the home position when the engagement coupler is moved by the reset structure from the first position to the second position thereof.

12. The assembly of claim 7, further comprising a bellcrank rotatably coupled to the cassette and configured to actuate a latch mechanism of the access closure upon rotation of the bellcrank to an unlatching position to allow the access closure to be opened, wherein the inertia-activated member in the inertia-activated position blocks rotation of the bellcrank to the unlatching position to prevent actuation of the latch mechanism, and wherein the inertia-activated member in the home position does not block rotation of the bellcrank to the unlatching position.

* * * * *